US007017453B2

(12) United States Patent
Hu

(10) Patent No.: US 7,017,453 B2
(45) Date of Patent: Mar. 28, 2006

(54) REVERSIBLE RATCHET-TYPE WRENCH

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 116 days.

(21) Appl. No.: 10/233,732

(22) Filed: Sep. 3, 2002

(65) Prior Publication Data

US 2003/0070512 A1 Apr. 17, 2003

(30) Foreign Application Priority Data

Oct. 17, 2001 (TW) ..... 90217709 U

(51) Int. Cl.
*B25B 13/46* (2006.01)

(52) U.S. Cl. ..... 81/63.2

(58) Field of Classification Search ..... 81/61–63.2
See application file for complete search history.

(56) References Cited

U.S. PATENT DOCUMENTS

| | | | | |
|---|---|---|---|---|
| 15,482 | A | 8/1856 | Gilman | 81/63 |
| 726,012 | A | 4/1903 | Andrew | |
| 810,599 | A | 1/1906 | Ansorge | |
| 818,761 | A | 4/1906 | Hanes et al. | 81/58.1 |
| 841,686 | A | 1/1907 | Hatfield | |
| 878,657 | A | 2/1908 | Munch | |
| 893,097 | A | 7/1908 | Reams | |
| 915,446 | A | 3/1909 | Kearnes | |
| RE13,205 | E | 2/1911 | Lane | 81/60 |
| 1,033,358 | A | 7/1912 | Turner | |
| 1,078,059 | A | 11/1913 | Mossberg | |
| 1,090,578 | A | 3/1914 | Smythe | |
| 1,194,471 | A | 8/1916 | Boosinger | |
| 1,261,092 | A | 4/1918 | Allen | |
| 1,382,492 | A | 6/1921 | Evans | 81/63 |
| 1,426,127 | A | 8/1922 | Tuttle | |
| 1,601,767 | A | 10/1926 | Peterson | 81/58.1 |
| 1,614,039 | A | 1/1927 | Mandl | |
| 1,639,078 | A | 8/1927 | Coe | |
| 1,680,515 | A | 8/1928 | Gormley | |
| 1,772,524 | A | 8/1930 | Seidemann | 81/58.1 |
| 1,957,462 | A | 5/1934 | Kress | 81/63 |
| 2,193,984 | A | 3/1940 | Rhinevault | 192/43.2 |
| 2,201,705 | A | 5/1940 | Stone | 192/43.2 |

(Continued)

FOREIGN PATENT DOCUMENTS

DE 921198 12/1954

(Continued)

OTHER PUBLICATIONS

Tool and Manufacturing Engineers Handbook, 1976, 3rd Edition, pp. 6-48.

*Primary Examiner*—Debra S Meislin
(74) *Attorney, Agent, or Firm*—Alan D. Kamrath; Nikolai & Mersereau, P.A.

(57) ABSTRACT

A wrench includes a handle, a head extending from the handle and having a hole for rotatably receiving a drive member, and a web defined between the handle and the head. The web includes a side and a compartment communicated with the hole of the head. An opening is defined in the side of the web and communicated with the compartment. A pawl is slidably received in the compartment and includes a recessed portion. A switching member has a first end for manual operation and a second end extending through the opening of the web into the recessed portion of the pawl. The recessed portion of the pawl and the second end of the switching member are so configured that the switching member is not moved when the pawl moves as a result of free rotation of the wrench.

20 Claims, 19 Drawing Sheets

U.S. PATENT DOCUMENTS

| | | | | |
|---|---|---|---|---|
| 2,201,827 | A | 5/1940 | Froeschl et al | 192/43.2 |
| 2,317,461 | A | 4/1943 | Jackson | |
| 2,542,241 | A | 2/1951 | Fors | |
| 2,612,807 | A | 10/1952 | Hunt | 81/58.1 |
| 2,657,604 | A | 11/1953 | Rueb | 81/63.2 |
| 2,701,977 | A | 2/1955 | Stone | |
| 2,735,324 | A | 2/1956 | Goldwater, et al. | 81/60 |
| 2,764,048 | A | 9/1956 | Thompson | |
| 2,769,360 | A | 11/1956 | Cottrell et al. | |
| 2,800,821 | A | 7/1957 | Fruscella | |
| 2,803,980 | A | 8/1957 | Vogel | 81/62 |
| 2,891,434 | A | 6/1959 | Lozensky | |
| 2,957,377 | A | 10/1960 | Hare | |
| 2,978,081 | A | 4/1961 | Lundin | 192/43.1 |
| 3,019,682 | A | 2/1962 | Hare | |
| 3,044,591 | A | 7/1962 | Kilness | |
| 3,233,481 | A | 2/1966 | Bacon | |
| 3,250,157 | A | 5/1966 | Badger | |
| 3,265,171 | A | 8/1966 | Kilness | 81/63 |
| 3,269,496 | A | 8/1966 | Kilness | |
| 3,337,014 | A | 8/1967 | Sandrick | 81/63 |
| 3,342,229 | A | 9/1967 | Janes | |
| 3,393,587 | A | 7/1968 | Jolliff et al. | |
| 3,393,780 | A | 7/1968 | Kilness | 81/63 |
| 3,436,992 | A | 4/1969 | Over et al. | |
| 3,508,455 | A | 4/1970 | Miller | 81/58.1 |
| 3,575,069 | A | 4/1971 | White | 81/58.1 |
| 3,577,816 | A | 5/1971 | Alexander et al. | |
| 3,598,001 | A | 8/1971 | Thomasian | 81/63.1 |
| 3,606,940 | A | 9/1971 | Finkeldei | |
| 3,691,876 | A | 9/1972 | Cassidy, Jr. | 81/58.1 |
| 3,713,356 | A | 1/1973 | Knudsen | |
| 3,742,788 | A | 7/1973 | Priest | |
| 3,783,703 | A | 1/1974 | Trimble et al. | |
| 3,838,614 | A | 10/1974 | O'Donnell | |
| 3,866,492 | A | 2/1975 | Knoll | |
| 3,908,487 | A | 9/1975 | Plaw | 81/59.1 |
| 3,970,155 | A | 7/1976 | Otto | |
| 4,053,037 | A | 10/1977 | Solomon | |
| 4,070,932 | A | 1/1978 | Jeannotte | 81/177 |
| 4,111,077 | A | 9/1978 | Cummings et al. | |
| 4,128,025 | A | 12/1978 | Main et al. | 81/63 |
| 4,147,076 | A | 4/1979 | Wright et al. | |
| 4,257,507 | A | 3/1981 | Solomon | |
| 4,274,311 | A | 6/1981 | Ebert | |
| 4,277,989 | A | 7/1981 | Tracy | |
| 4,277,990 | A | 7/1981 | Hall | |
| 4,308,768 | A | 1/1982 | Wagner | |
| 4,308,769 | A | 1/1982 | Rantanen | |
| 4,328,720 | A | 5/1982 | Shiel | |
| 4,336,728 | A | 6/1982 | Deibert | |
| 4,406,186 | A | 9/1983 | Gummow | |
| 4,420,995 | A | 12/1983 | Roberts | |
| 4,485,700 | A | 12/1984 | Colvin | |
| 4,488,460 | A | 12/1984 | Ballone, et al. | |
| 4,512,218 | A | 4/1985 | Chow | |
| 4,520,697 | A | 6/1985 | Moetteli | |
| 4,631,988 | A | 12/1986 | Colvin | |
| 4,662,251 | A | 5/1987 | Kohal | |
| 4,709,600 | A | 12/1987 | Mierbach et al. | |
| 4,722,252 | A | 2/1988 | Fulcher et al. | |
| 4,722,253 | A | 2/1988 | Chow | |
| 4,762,033 | A | 8/1988 | Chow | |
| 4,770,072 | A | 9/1988 | Neuhaus | 81/63.2 |
| 4,777,852 | A | 10/1988 | Herman et al. | |
| 4,796,492 | A | 1/1989 | Liou | 81/58 |
| 4,807,500 | A | 2/1989 | Main | |
| 4,862,775 | A | 9/1989 | Chow | 83/63.2 |
| 4,869,138 | A | 9/1989 | Farris | |
| 4,903,554 | A | 2/1990 | Colvin | |
| 4,924,737 | A | 5/1990 | Gummow | |
| 4,934,220 | A | 6/1990 | Slusar et al. | |
| 4,986,147 | A | 1/1991 | Cooper | |
| 4,991,468 | A | 2/1991 | Lee | |
| 5,000,066 | A | 3/1991 | Gentiluomo | 81/62 |
| 5,012,705 | A | 5/1991 | Chow | |
| 5,038,452 | A | 8/1991 | Beugelsdyk et al. | 29/436 |
| 5,076,121 | A | 12/1991 | Fosella | 81/58.4 |
| 5,095,781 | A | 3/1992 | Blake | 81/58.1 |
| 5,144,869 | A | 9/1992 | Chow | |
| 5,157,994 | A | 10/1992 | Krivec | 81/63.2 |
| 5,178,047 | A | 1/1993 | Arnold et al. | 81/63.2 |
| 5,199,330 | A * | 4/1993 | Arnold et al. | 81/63.2 |
| 5,199,335 | A | 4/1993 | Arnold et al. | |
| 5,230,262 | A | 7/1993 | Ahlund et al. | 81/63.2 |
| 5,231,903 | A | 8/1993 | Bockman, Jr. | |
| 5,347,892 | A | 9/1994 | Moetteli | |
| 5,404,773 | A | 4/1995 | Norville | |
| 5,448,931 | A | 9/1995 | Fosella et al. | |
| 5,522,288 | A | 6/1996 | Slusar et al. | |
| 5,535,646 | A | 7/1996 | Allen et al. | |
| 5,557,994 | A | 9/1996 | Nakayama | 81/478 |
| 5,584,220 | A | 12/1996 | Darrah et al. | |
| 5,595,095 | A | 1/1997 | Hillinger | 81/58.3 |
| 5,622,089 | A | 4/1997 | Gifford, Sr. | 81/62 |
| 5,669,875 | A | 9/1997 | van Eerdenburg | |
| 5,749,272 | A | 5/1998 | Phan | 81/62 |
| 5,878,635 | A | 3/1999 | Hsieh | |
| 5,884,537 | A | 3/1999 | Chen | |
| 5,887,493 | A | 3/1999 | Main | |
| 5,970,552 | A | 10/1999 | Kwiecien et al. | 7/143 |
| 5,979,274 | A | 11/1999 | Hsieh | 81/60 |
| 6,006,631 | A | 12/1999 | Miner et al. | |
| 6,044,731 | A | 4/2000 | Hsieh | |
| 6,065,374 | A | 5/2000 | Taggart | 81/63.2 |
| 6,125,722 | A | 10/2000 | Hopper, Jr. et al. | |
| 6,134,990 | A | 10/2000 | Ling, et al. | |
| 6,134,991 | A | 10/2000 | Chaconas | |
| D433,896 | S | 11/2000 | Wei | |
| D434,292 | S | 11/2000 | Hsieh | |
| 6,148,695 | A | 11/2000 | Hu | |
| 6,152,826 | A | 11/2000 | Profeta, et al. | |
| 6,155,140 | A | 12/2000 | Tsai | |
| 6,161,454 | A | 12/2000 | Chaconas | |
| 6,164,167 | A | 12/2000 | Chen | 81/63.2 |
| 6,205,889 | B1 | 3/2001 | Hsieh | |
| 6,209,423 | B1 | 4/2001 | Shiao | 81/62 |
| 6,216,563 | B1 | 4/2001 | Hsieh | 81/63.2 |
| 6,216,567 | B1 | 4/2001 | Hu | |
| 6,220,123 | B1 | 4/2001 | Chen | |
| 6,230,591 | B1 | 5/2001 | Ling et al. | |
| 6,240,813 | B1 | 6/2001 | Hyatt | |
| 6,257,096 | B1 | 7/2001 | Ling | |
| 6,257,097 | B1 | 7/2001 | I-He | |
| 6,260,448 | B1 | 7/2001 | Chaconas | |
| 6,260,449 | B1 | 7/2001 | I-He | |
| 6,263,767 | B1 | 7/2001 | Hu | |
| 6,282,991 | B1 | 9/2001 | Hu | |
| 6,282,992 | B1 | 9/2001 | Hu | 81/63.2 |
| 6,282,993 | B1 | 9/2001 | Forman, et al. | |
| 6,301,998 | B1 | 10/2001 | Hu | 81/60 |
| 6,308,594 | B1 | 10/2001 | Cheng | 81/62 |
| 6,332,382 | B1 | 12/2001 | Anderson et al. | 81/438 |
| 6,334,373 | B1 | 1/2002 | Hsieh | |
| 6,382,051 | B1 | 5/2002 | Chang | 81/60 |
| 6,382,052 | B1 | 5/2002 | Chen | 81/63 |
| 6,386,072 | B1 | 5/2002 | Yuan-Chin et al. | 81/63.2 |
| 6,427,560 | B1 | 8/2002 | Shea | 81/58.1 |
| 6,431,031 | B1 | 8/2002 | Hu | 81/63.2 |
| 6,435,062 | B1 | 8/2002 | McCann | 81/63 |
| 6,435,063 | B1 | 8/2002 | Chen | 81/63.2 |
| 6,450,066 | B1 | 9/2002 | Hu | 81/60 |
| 6,450,068 | B1 | 9/2002 | Hu | 81/63.2 |
| 6,453,779 | B1 | 9/2002 | Hu | 81/63 |

| | | | | |
|---|---|---|---|---|
| 6,457,387 | B1 | 10/2002 | Hu | 81/63.2 |
| 6,457,388 | B1 | 10/2002 | Chen | 81/63.2 |
| 6,457,389 | B1 | 10/2002 | Hu | 81/63.2 |
| 6,488,136 | B1 | 12/2002 | Chang | |
| 6,516,691 | B1 * | 2/2003 | Wei | 81/63.2 |
| 6,520,051 | B1 | 2/2003 | Hu | 81/60 |
| 6,539,825 | B1 | 4/2003 | Lin | 81/60 |
| 6,568,299 | B1 | 5/2003 | Hu | 81/63.2 |
| 6,591,717 | B1 | 7/2003 | Wei | 81/60 |
| 6,629,477 | B1 | 10/2003 | Ling, et al. | 81/63.2 |
| 6,644,148 | B1 | 11/2003 | Hu | 81/63.2 |
| 6,647,832 | B1 | 11/2003 | Hu | 81/63.2 |
| 6,662,693 | B1 | 12/2003 | Hu | 81/467 |
| 6,666,112 | B1 | 12/2003 | Hu | 81/63.2 |
| 6,666,117 | B1 | 12/2003 | Hu | 81/467 |
| 6,688,195 | B1 | 2/2004 | Hsien | 81/60 |
| 6,708,586 | B1 | 3/2004 | Chen | 81/63.2 |
| 6,722,234 | B1 | 4/2004 | Hu | 81/63.2 |
| 6,732,614 | B1 | 5/2004 | Hu | 81/63.2 |
| 6,745,647 | B1 | 6/2004 | Wang | 81/60 |
| 6,748,825 | B1 | 6/2004 | Hsu | 81/60 |
| 6,758,641 | B1 | 7/2004 | Hu | 409/132 |
| 6,761,092 | B1 | 7/2004 | Hsien | 81/63.2 |
| 2002/0023520 | A1 | 2/2002 | Hu | 81/63.2 |
| 2002/0162423 | A1 | 11/2002 | Hu | 81/60 |
| 2002/0162424 | A1 | 11/2002 | Hu | |
| 2002/0166417 | A1 | 11/2002 | Hu | |
| 2002/0166418 | A1 | 11/2002 | Hsieh | 81/125 |
| 2002/0194950 | A1 | 12/2002 | Hu | 74/577 |
| 2003/0010159 | A1 | 1/2003 | Hu | |
| 2003/0070512 | A1 | 4/2003 | Hu | 81/63.2 |
| 2003/0121373 | A1 | 7/2003 | Ling et al. | 81/63.2 |
| 2003/0154826 | A1 | 8/2003 | Lee | 81/63.1 |
| 2003/0196522 | A1 | 10/2003 | Hu | 81/63.2 |
| 2004/0093995 | A1 | 5/2004 | Hu | 81/63.2 |

FOREIGN PATENT DOCUMENTS

| | | |
|---|---|---|
| FR | 498276 | 1/1920 |
| GB | 1559093 | 1/1980 |
| GB | 2135226 | 8/1984 |

* cited by examiner

REVERSIBLE RATCHET-TYPE WRENCH

BACKGROUND OF THE INVENTION

1. Field of the Invention

The present invention relates to a reversible ratchet-type wrench. In particular, the present invention relates to a ratchet-type wrench that allows reversible operations without the risk of movement of a switching member for switching the ratcheting direction.

2. Description of the Related Art

Wrenches are an important hand tool and have many types such as spanners, adjusting wrenches, combination wrenches, and socket wrenches. Ring spanners are very useful when the fastener to be tightened/loosened is located in a difficult-to-access place. However, the ring spanners could not be operated in a reverse direction and thus require troublesome disengagement of the ring spanner from the fastener and reengagement of the ring spanner until tightening/loosening of the fastener is achieved.

U.S. Pat. No. 6,220,123 to Chen issued on Apr. 24, 2001 discloses a structure of a ratchet wrench comprising a ratchet wheel mounted in a circular opening of a wrench head of a common ratchet, and a cavity is provided in the circular opening adjacent to one side of the rod body of the wrench for mounting a restrictive teeth structure. The end terminal of the cavity is provided with a ball hole to contain a spring and a steel ball, and the restrictive teeth structure is urged by the steel ball to thereby control the high-torque movement of the ratchet wheel. A rotating disc is used to cover the opening and includes ratchet teeth for meshing top ratchet teeth of the restrictive teeth structure. However, the formation of top and bottom ratchet teeth on a side of the restrictive teeth structure would not be easy, and this decreases the torque-bearing capacity of the ratchet wrench, as the meshing area between the restrictive teeth structure and the ratchet wheel is reduced. Further, the restrictive teeth structure could not be reliably positioned, as there is no positioning means provided between the rotating disc and the wrench body. As a result, the rotating disc moves together with the restrictive teeth structure when the ratchet wrench turns freely. Further, since the top ratchet teeth of the restrictive teeth structure meshes with the ratchet teeth of the rotating disc and the bottom ratchet teeth of the rotating disc meshes with the ratchet teeth of the ratchet wheel, the ratchet wrench must be disengaged from the fastener before switching of the ratcheting direction through rotation of the rotating disc. Further, the engaging force between the ratchet wheel and the rotating disc provided by a C-shaped fastening ring was found to be poor. As a result, the ratchet wheel and the rotating disc could fly away from the wrench body when the ratchet wrench is subject to a relatively high torque.

FIGS. 16 and 17 of the drawings illustrate a conventional wrench comprising a handle 21' and a head 20' extended from the handle 21'. A hole 22' is defined in the head 20' and a compartment 23' is defined in a wall defining the hole 22'. A transverse groove 24' is defined in a side of a web portion between the handle 21' and the head 20'. A spring 61' and a ball 62' are received in a receptacle 25' defined in a bottom wall defining the transverse groove 24'. A drive member 30' is rotatably mounted in the hole 22'. Two pawls 40' are slidably mounted in the compartment 23' and connected by a spring 43'. A switching member 50' is slidably engaged in the transverse groove 24' and includes a U-shaped portion 52' that is located in an overlapped portion between the transverse groove 24' and the compartment 23'. The overlapped portion is designed to expose the peg 42' on each pawl 40', allowing the switching member 50' to move the pawls 40'. The ball 62' is biased by the spring 61' to selectively engage with one of three retaining holes 53' of the switching member 50' such that the teeth 41' of one of the pawls 40' is engaged with the teeth 33' of the drive member 30', thereby switching the ratcheting direction of the wrench. However, the overlapped portion results in a thin wall thickness (L) of the head 20', which adversely affects the torque-bearing capacity. A solution for increasing the torque-bearing capacity is to increase the wall thickness (L) of the head, yet this requires a deep transverse groove 24' and a thick switching member 50' as well as dovetail engagement between the transverse groove 24' and the switching member 50' for avoiding disengagement therebetween. This would increase the difficulty of manufacture. Further, the U-shaped portion 52' of the switching member 50' and the overlapped portion of the transverse groove 24' and the compartment 23' are exposed such that alien objects may enter the compartment 23' and thus cause malfunction of the wrench.

FIGS. 18 and 19 illustrate another conventional wrench comprising a handle 1" and a head 11" extended from the handle 1". A hole 14" is defined in the head 11" for rotatably receiving a drive member 2". A transverse hole 12" having an open end is defined in a web between the handle 1" and the head 11". A spring 4" and a ball 5" are received in a receptacle defined in a peripheral wall defining the transverse hole 12". A pawl 3" having two toothed sections 31" is slidably mounted in the transverse hole 12" and then sealed by a cap 9". A substantially T-shaped switching member 8" includes a horizontal section 81" outside the head 11" for manual operation and a threaded vertical section 82" extending through a slot 13" in the web into a screw hole 33" in the pawl 3". Thus, the pawl 3" is moved in the transverse hole 12" when the switching member 8" is moved. The ball 5" is biased by the spring 4" to engage with one of two retaining grooves 32" of the pawl 3" such that one of the toothed sections 31" of the pawl 3" is engaged with the teeth of the drive member 2", thereby deciding the ratcheting direction of the wrench. However, the cap 9" is apt to be disengaged from the transverse hole 12". The movement of the pawl 3" is limited if the cap 9" is mounted in a deeper position for avoiding disengagement. The threaded vertical section 82" of the switching member 8" and the screw hole 33" of the pawl 3" result in difficulty in manufacture and assembly. The threaded vertical section 82" of the switching member 8" tends to be disengaged from the screw hole 33" of the pawl 3" after a period of time, and the wrench malfunctions accordingly.

SUMMARY OF THE INVENTION

It is, therefore, an objective of the present invention to provide a ratchet-type wrench that allows reversible operations without the risk of movement of a switching member for switching the ratcheting direction.

A wrench in accordance with the present invention comprises:

a handle;

a head extending from the handle and including a hole;

a web defined between the handle and the head, the web including a side and a compartment communicated with the hole of the head, an opening being defined in the side of the web and communicated with the compartment;

a drive member rotatably mounted in the hole of the head and including a plurality of teeth in an outer periphery thereof;

a pawl slidably received in the compartment and including a first side having a plurality of teeth and a second side opposite to the first side, the pawl further including a recessed portion;

a switching member having a first end for manual operation and a second end extending through the opening of the web into the recessed portion of the pawl;

a pressing member mounted in the compartment; and an elastic element mounted in the compartment for urging the pressing member to press against the second side of the pawl for engaging the teeth of the pawl with the teeth of the drive member;

wherein the first end of the switching member is manually slidable to move the pawl between a first position and a second position corresponding to two opposite ratcheting directions of the wrench; and wherein the recessed portion of the pawl and the second end of the switching member are so configured that the switching member is not moved when the pawl moves as a result of free rotation of the wrench.

Other objectives and novel features of the invention will become more apparent from the following detailed description when taken in conjunction with the accompanying drawings.

DETAILED DESCRIPTION OF THE PREFERRED EMBODIMENTS

Figure 1:
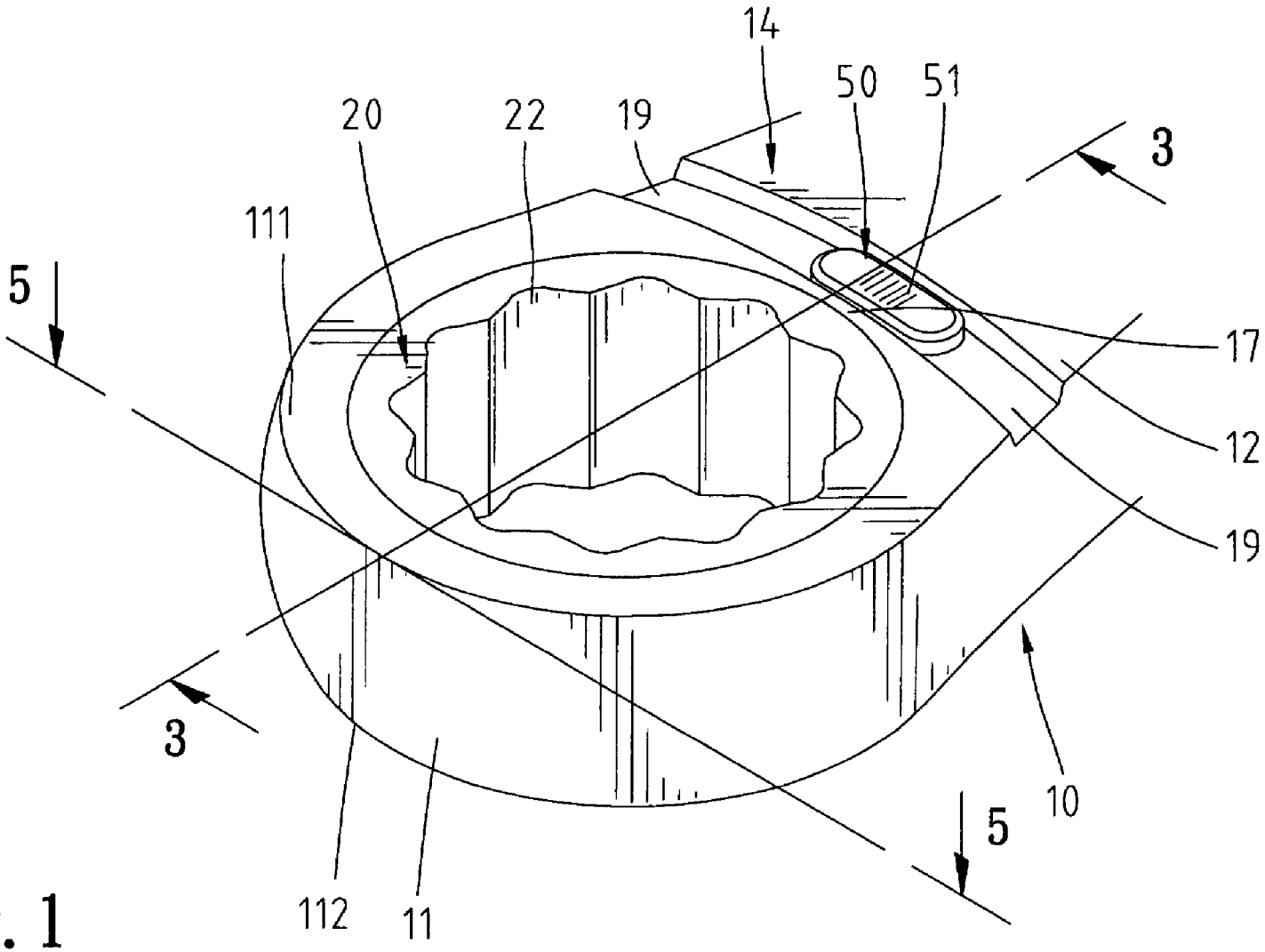
FIG. 1 is a perspective view of a ratchet-type reversible wrench in accordance with the present invention.
Figure 2:
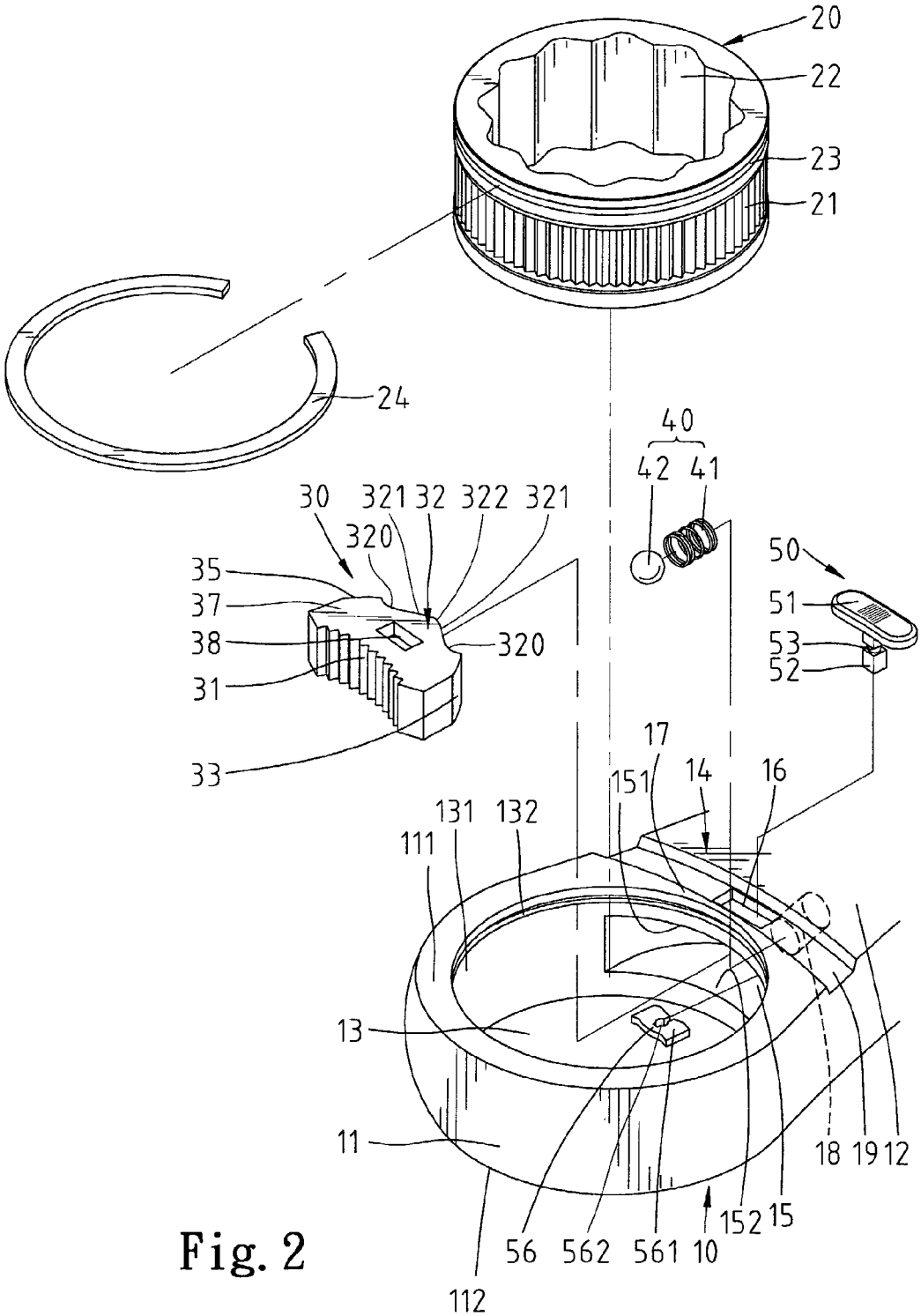
FIG. 2 is an exploded perspective view of the wrench in FIG. 1.
Figure 3:
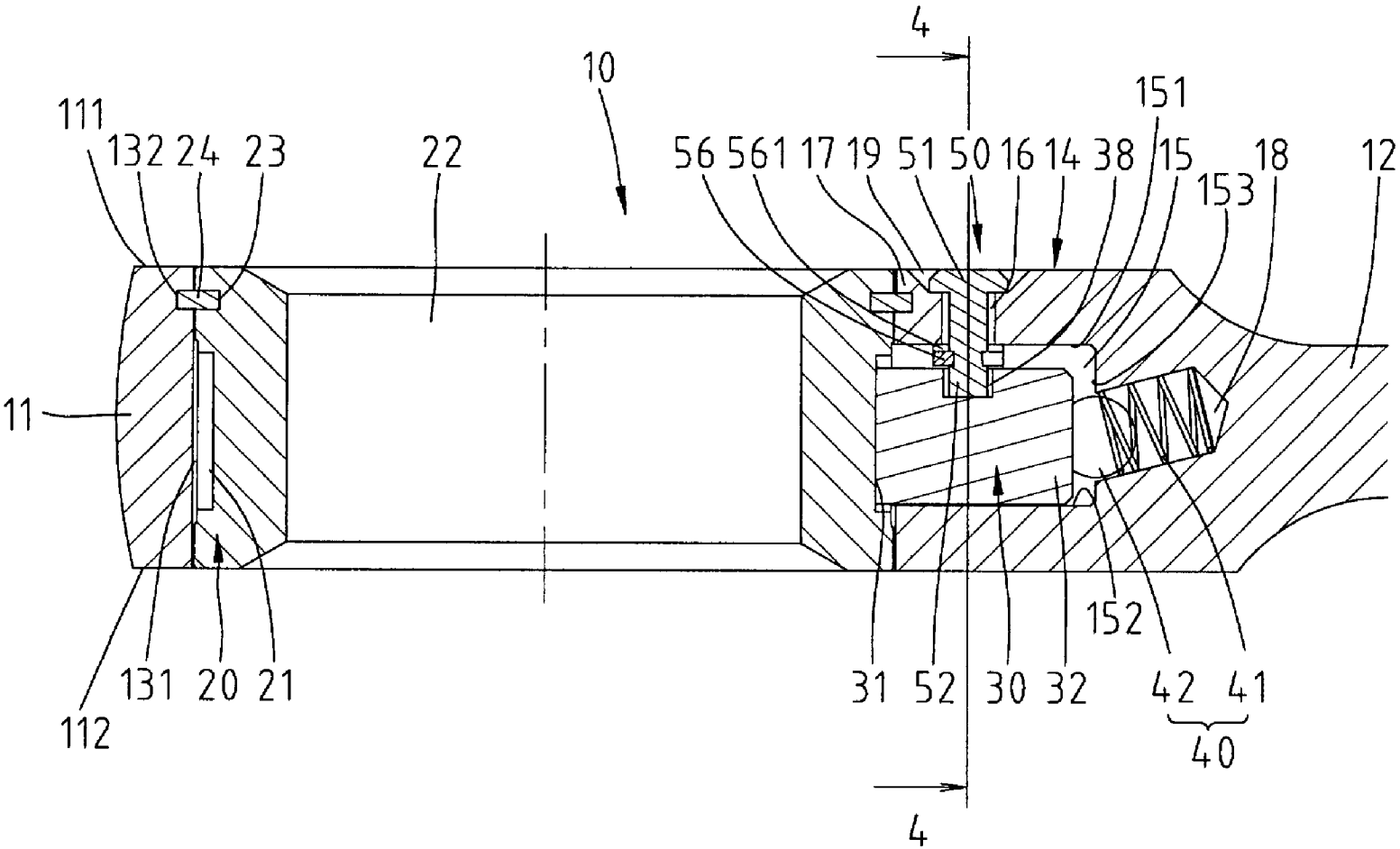
FIG. 3 is a sectional view taken along plane 3—3 in FIG. 1.

Referring to FIGS. 1 through 3, a reversible ratchet-type wrench in accordance with the present invention is designated by "10" and generally comprises a handle 12 and a head 11 extending from the handle 12. A web 14 is defined between the handle 12 and the head 11. A hole 13 is defined in the head 11 and extends from a top face 111 to a bottom face 112 of the head 11. A compartment 15 is defined in the web 14 and communicated with the hole 13 of the head 11. As illustrated in FIGS. 2 and 3, the compartment 15 is delimited by an upper wall 151, a bottom wall 152, and a peripheral wall 153. A receptacle 18 is defined in the peripheral wall 153 of the compartment 15 and faces the hole 13.

An opening (or slot or hole) 16 is defined in a side of the web 14 (i.e., the upper wall 151 of the compartment 15) and communicated with the compartment 15. In this embodiment, a transverse channel 19 is defined in the side of the web 14 and extends from a lateral side of the web 14 through the other lateral side of the web 14. The opening 16 is defined in a bottom wall defining the transverse channel 19, leaving a bridge 17 between the web 14 and the head 11. It is noted that the head 11 is still integral with the handle 12 via the bridge 17 and the bottom wall defining the transverse channel 19, providing a strong structure. An annular groove 132 is defined in an end of a peripheral wall 131 defining the hole 13 of the head 11.

A drive member 20 is rotatably mounted in the hole 13 of the head 11. In this embodiment, the drive member 20 is a gear wheel including a plurality of teeth 21 in an outer periphery thereof. The outer periphery of the gear wheel 20 includes an annular groove 23 in an upper end thereof. Further, the gear wheel 20 includes an inner periphery 22 for driving a fastener (not shown). A C-clip 24 is partially engaged in the annular groove 23 of the gear wheel 20 and partially engaged in the annular groove 132 of the head 11, thereby rotatably mounting the gear wheel 20 in the hole 13.

A pawl 30 is slidably mounted in the compartment 15 and includes a first lateral side having a plurality of teeth 31 and a second lateral side opposite to the first lateral side. A retaining section 32 is formed on the second lateral side of the pawl 30. In this embodiment, the retaining section 32 includes two retaining grooves 320 spaced by a ridge 322, each retaining groove 320 including a retaining portion 321. The pawl 30 further includes two pressing ends 33 and 35 for pressing against the peripheral wall 153 defining the compartment 15. Further, the pawl 30 includes a recessed portion 38 in a top side 37 thereof.

Mounted in the receptacle 18 is a biasing means 40 comprised of an elastic element 41 and a pressing member (e.g., a ball 42). The ball 42 is biased by the elastic element 41 to be selectively engaged in one of the retaining grooves 320 of the pawl 30, thereby selectively urging one of the pressing ends 33 and 35 of the pawl 30 to press against the peripheral wall 153 defining the compartment 15 and urging the teeth 31 of the pawl 30 to engage with the teeth 22 of the gear wheel 20.

Figure 4:
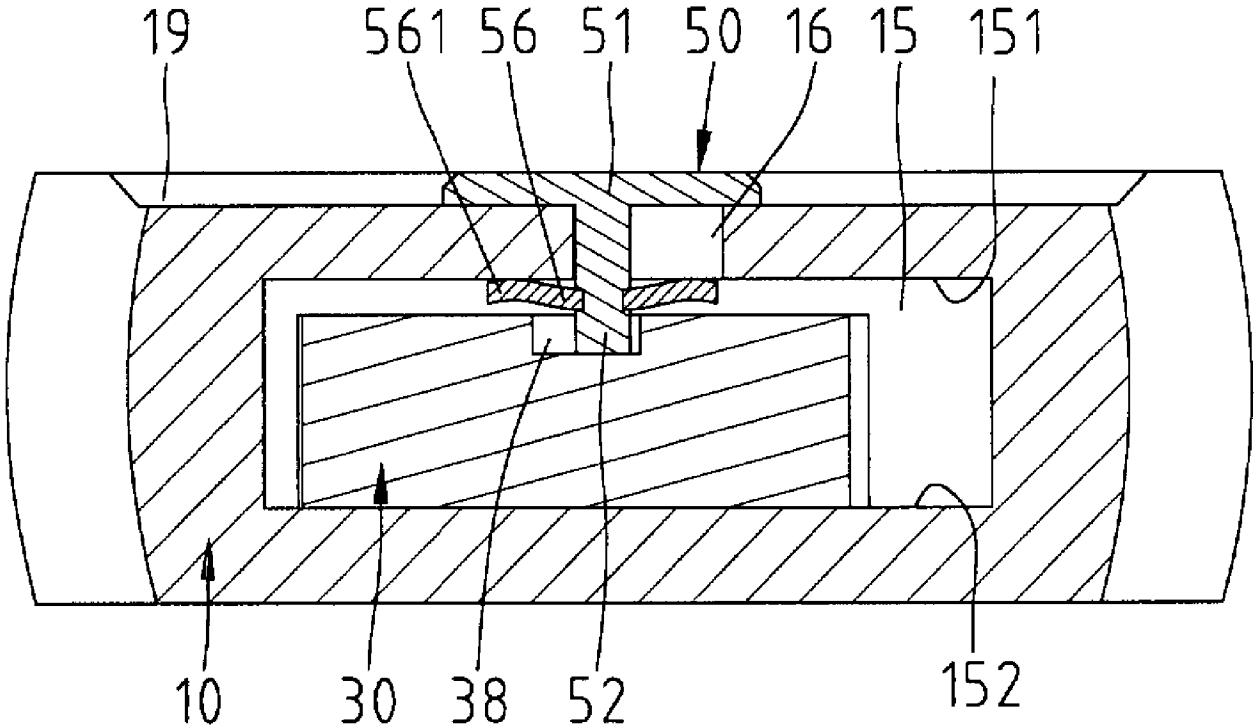
FIG. 4 is a sectional view taken along plane 4—4 in FIG. 3.

Still referring to FIGS. 1–3, the reversible ratchet wrench further includes a switching member 50 that is preferably T-shaped and has a first end 51 and a second end 52 with an engaging groove 53. The first end 51 of the switching member 50 is slidably received in the channel 19. The second end 52 of the switching member 50 extends through the opening 16 of the web 14 into the recessed portion 38 of the pawl 30. A resilient retaining plate 56 includes two curved sides 561 and an intermediate notched portion 562 between the curved sides 561. As illustrated in FIGS. 3 and 4, the resilient retaining plate 56 is engaged with the engaging groove 53 of the second end 52 of the switching member 50 at the intermediate notched portion 562, with the curved sides 561 of the resilient retaining plate 56 pressing against the upper wall 151 defining the compartment 15. Thus, the switching member 50 is retained in place unless a relatively large force is applied to the switching member 50 for moving the pawl 30 for switching the ratcheting direction of the wrench 10.

Figure 5:
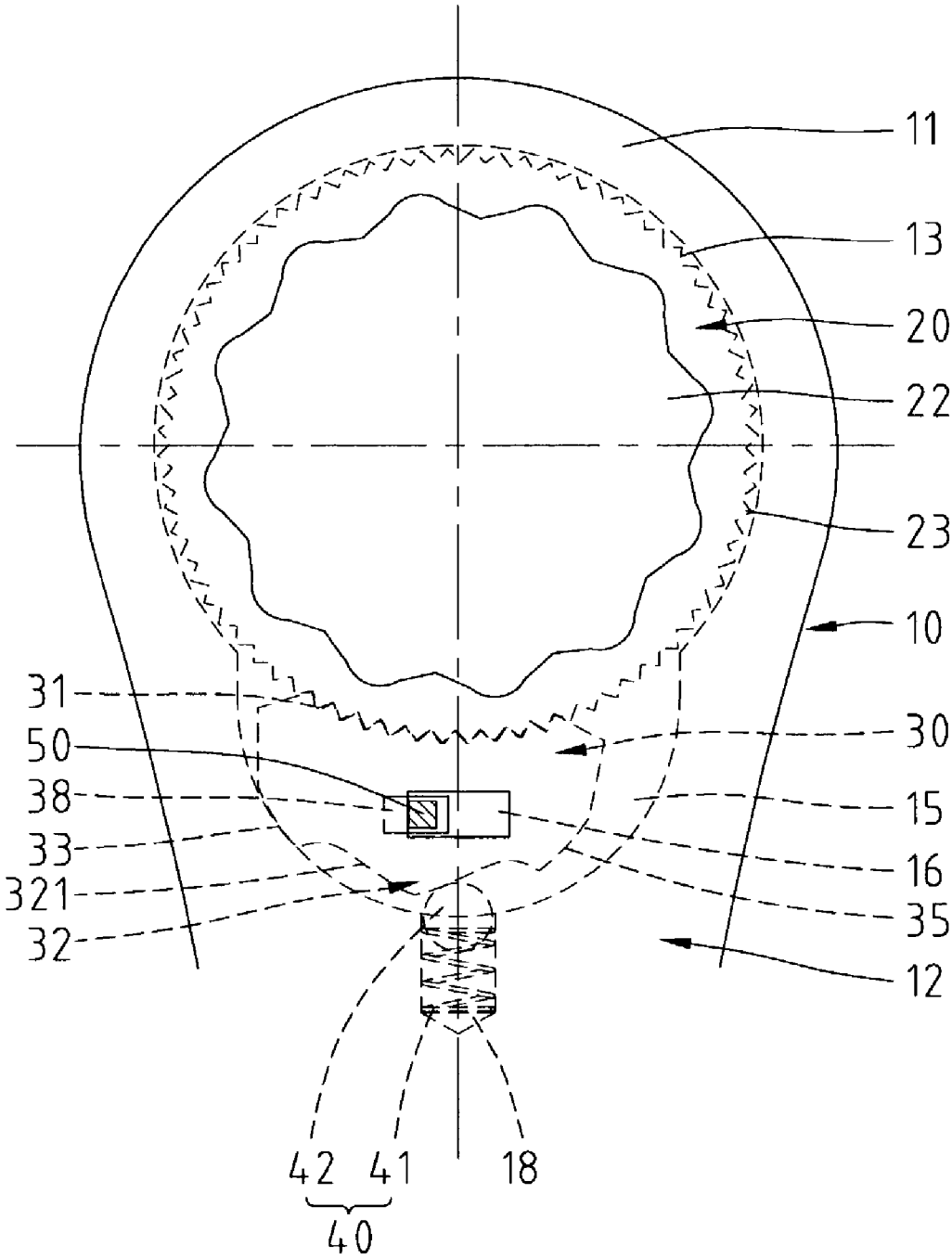
FIG. 5 is a sectional view taken along plane 5—5 in FIG. 1.

When the switching member 50 is in a position shown in FIG. 5, the second end 52 of the switching member 50 is located in a left end of the opening 16 of the web 14 and in a right portion of the recessed portion 38 of the pawl 30. The pressing end 33 presses against a portion of the peripheral wall 153 defining the compartment 15, allowing clockwise ratcheting operation and counterclockwise free rotation of the wrench 10.

Figure 6:
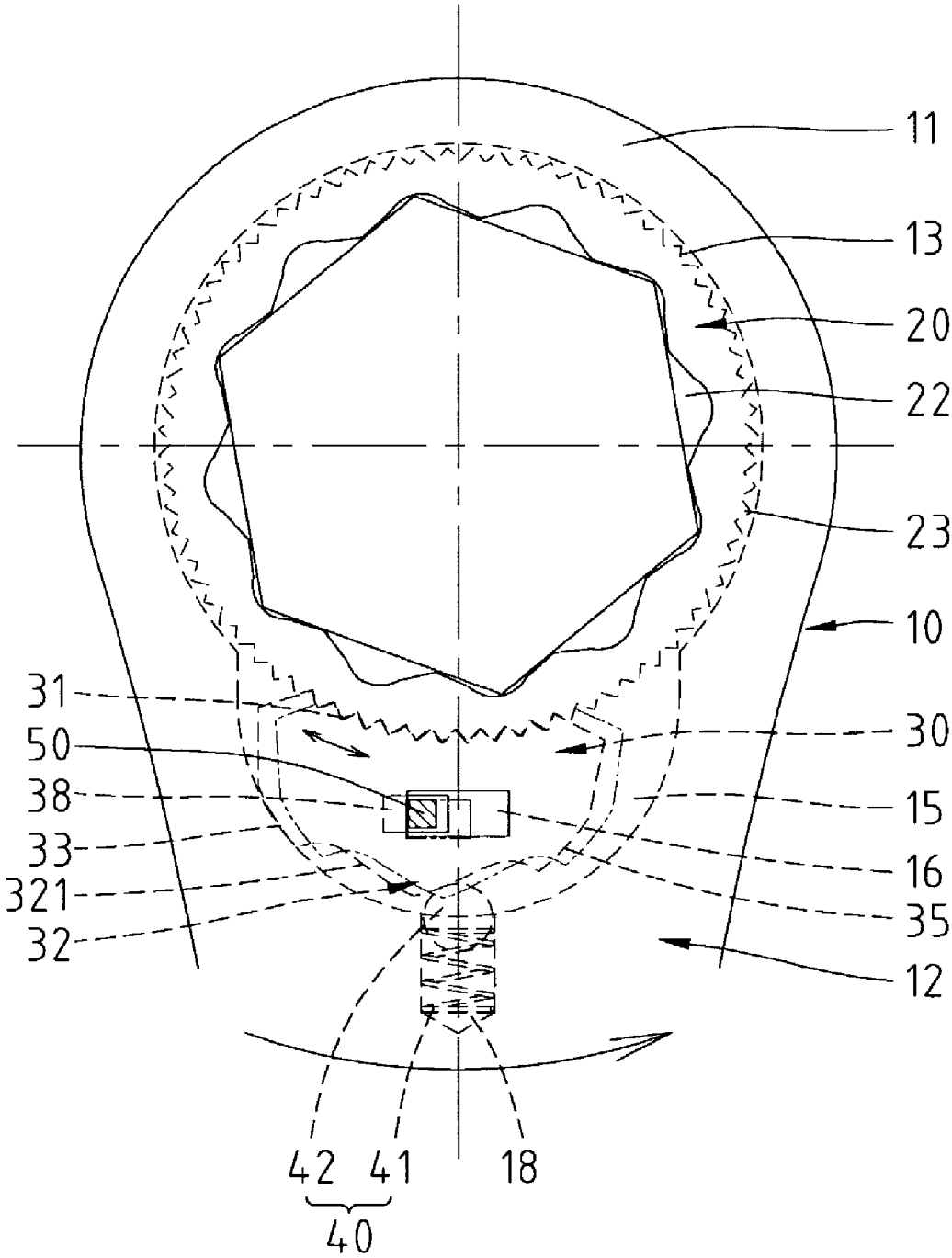
FIG. 6 is a view similar to FIG. 5, illustrating free rotation of the wrench handle.

FIG. 6 illustrates movement of the pawl 30 during free rotation of the wrench 10. Namely, when the wrench is turned counterclockwise, the pawl 30 slides away from the gear wheel 20 and compresses the elastic element 41 and then reengages with the gear wheel 20 under the action of the elastic element 41 and the ball 42. The procedure repeats and thus causes free rotation of the wrench 10; namely, the fastener (not shown) in the gear wheel 20 is not turned, as the gear wheel 20 is not driven by the pawl 30. Since the recessed portion 38 of the pawl 30 is wider than the second end 52 of the switching member 50 and since the second end 52 of the switching member 50 is located in the right portion of the recessed portion 38, the second end 52 of the switching member 50 is not moved when the pawl 30 moves during free rotation of the wrench 10.

Figure 7:
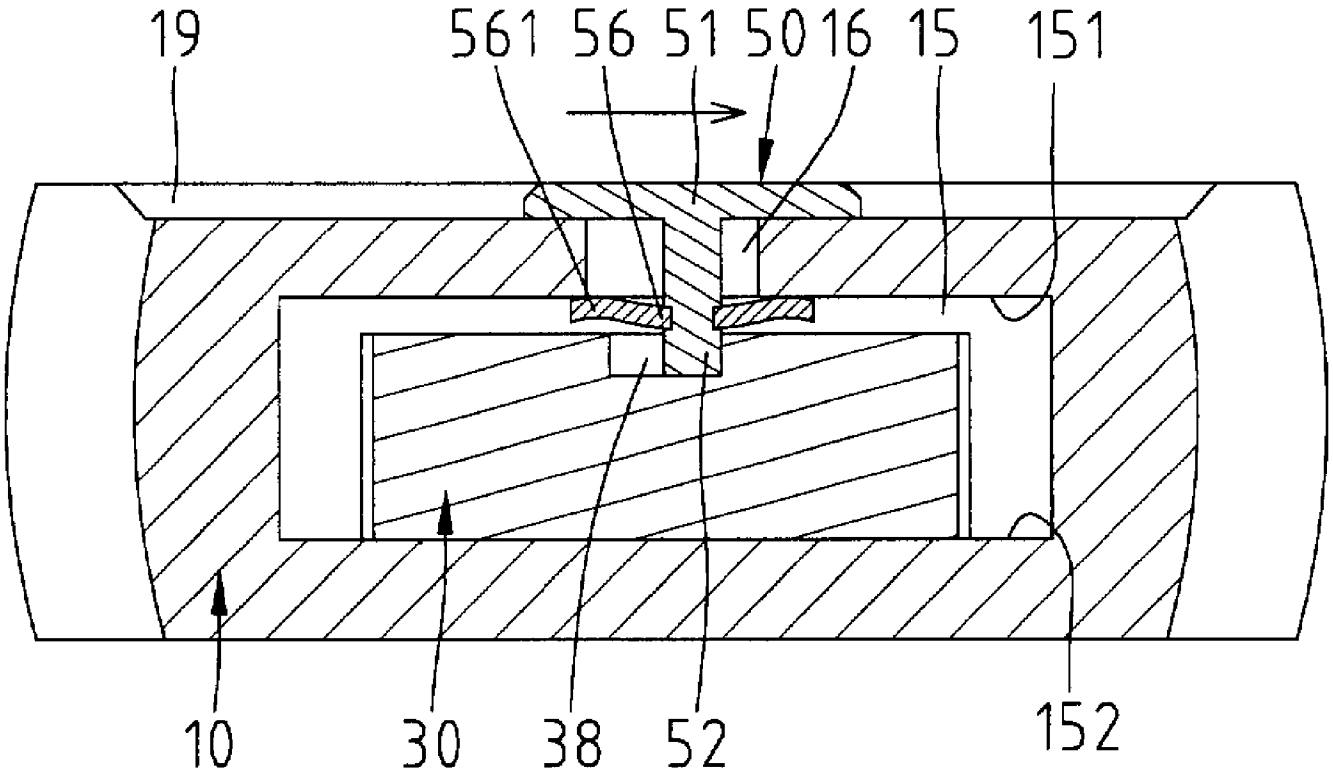
FIG. 7 is a view similar to FIG. 4, illustrating change in the ratcheting direction by moving a switching member.
Figure 8:
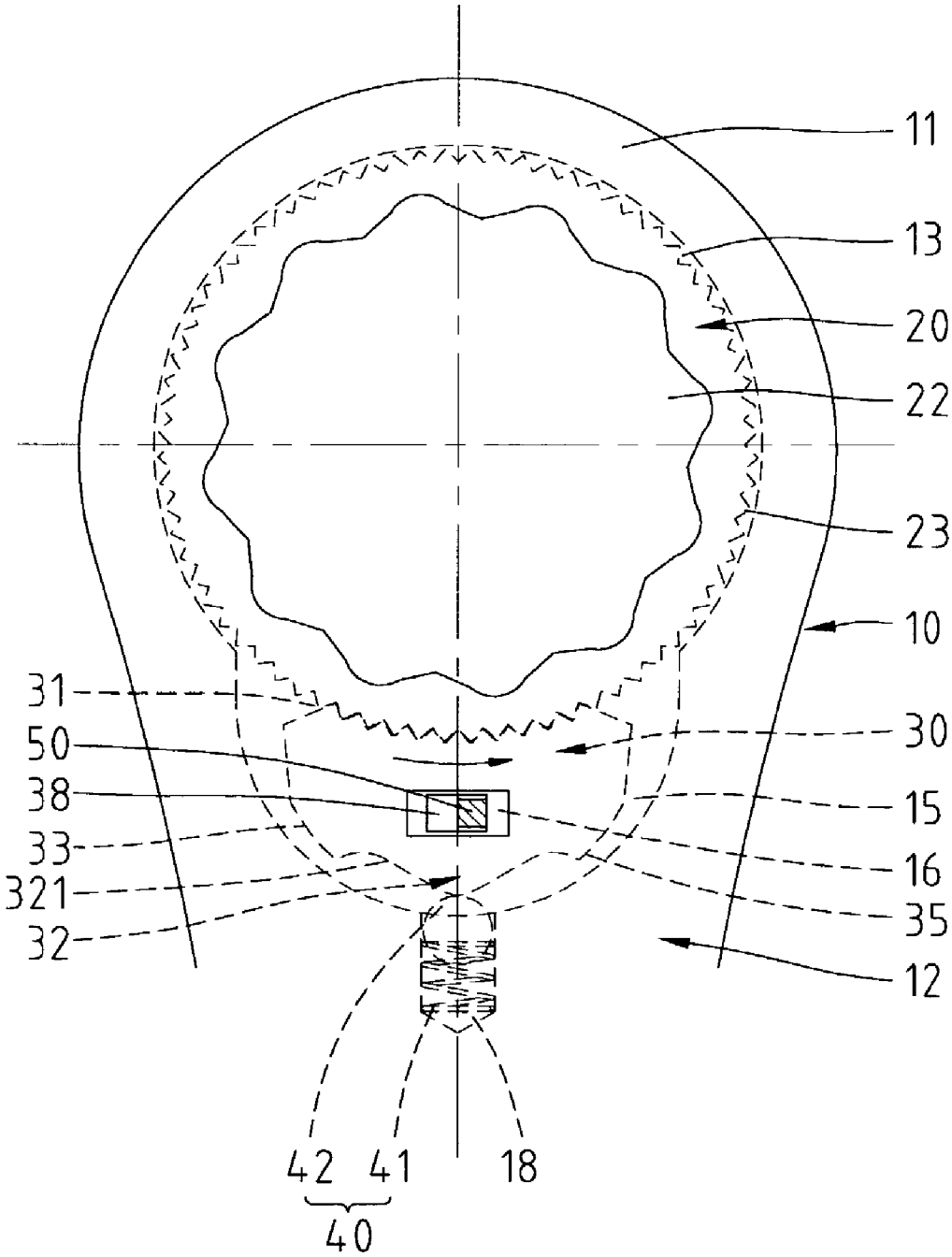
FIG. 8 is a sectional view similar to FIG. 5, illustrating a transition position of the pawl of the wrench during switching of the ratcheting direction.

Referring to FIGS. 7 and 8, when switching of the ratcheting direction of the wrench is required, the first end 51 of the switching member 50 is moved along the channel 19 until the ball 42 is moved to the ridge 322 and the second end 52 of the switching member 50 reaches the right end edge of the recessed portion 38 of the pawl 30. The first end 51 of the switching member 50 is further moved until the ball 42 moves across the ridge 322 into the other retaining groove 320. The pawl 30 is moved across the central line of the compartment 15 to the other side of the compartment 15, as shown in FIGS. 9 and 10.

Figure 9:
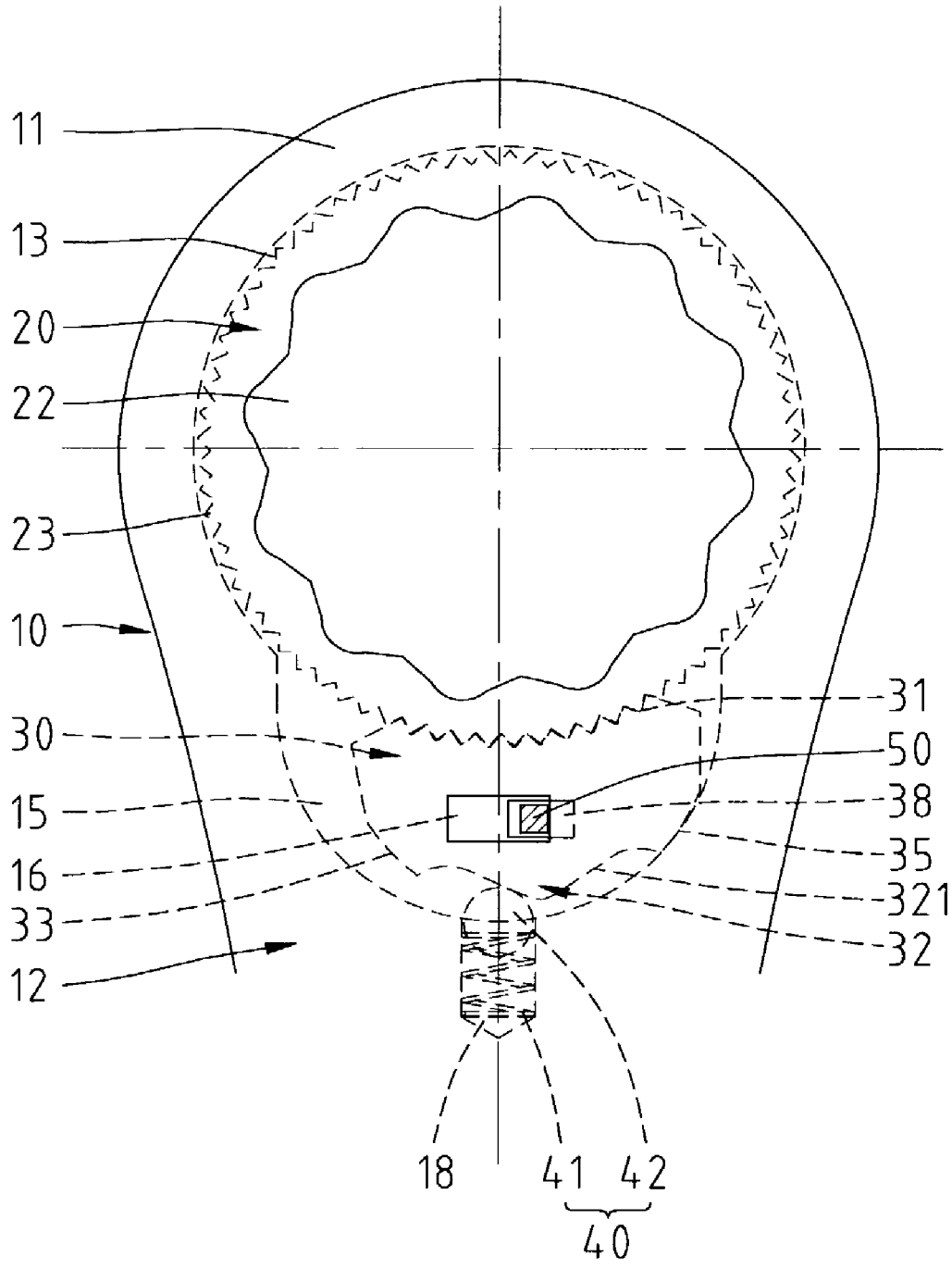
FIG. 9 is a sectional view similar to FIG. 5, illustrating a final position of the pawl of the wrench after switching of the ratcheting direction.
Figure 10:
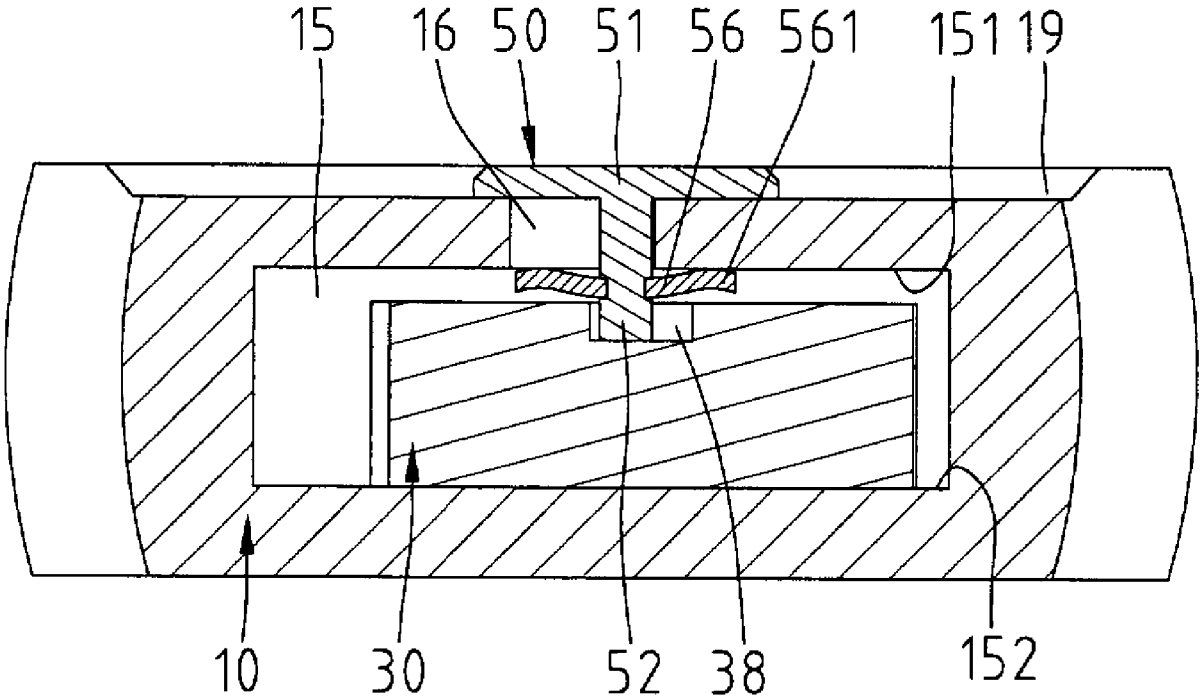
FIG. 10 is a sectional view similar to FIG. 4, illustrating a final position of the switching member of the wrench after switching of the ratcheting direction.

When the switching member 50 is in a position shown in FIGS. 9 and 10, the second end 52 of the switching member 50 is located in a right end of the opening 16 of the web 14 and in a left portion of the recessed portion 38 of the pawl 30. The pressing end 35 of the pawl 30 presses against another portion of the peripheral wall 153 defining the compartment 15, allowing counterclockwise ratcheting operation and clockwise free rotation of the wrench 10.

When the wrench is turned clockwise, the pawl 30 slides away from the gear wheel 20 and compresses the elastic element 41 and then reengages with the gear wheel 20 under the action of the elastic element 41 and the ball 42. The procedure repeats and thus causes free rotation of the wrench 10; namely, the fastener (not shown) in the gear wheel 20 is not turned, as the gear wheel 20 is not driven by the pawl 30. Since the recessed portion 38 of the pawl 30 is wider than the second end 52 of the switching member 50 and since the second end 52 of the switching member 50 is located in the left portion of the recessed portion 38, the second end 52 of the switching member 50 is not moved when the pawl 30 moves during free rotation of the wrench 10.

The first end 51 of the switching member 50 is flush with an upper end of the channel 19, allowing smooth operation.

Figure 11:
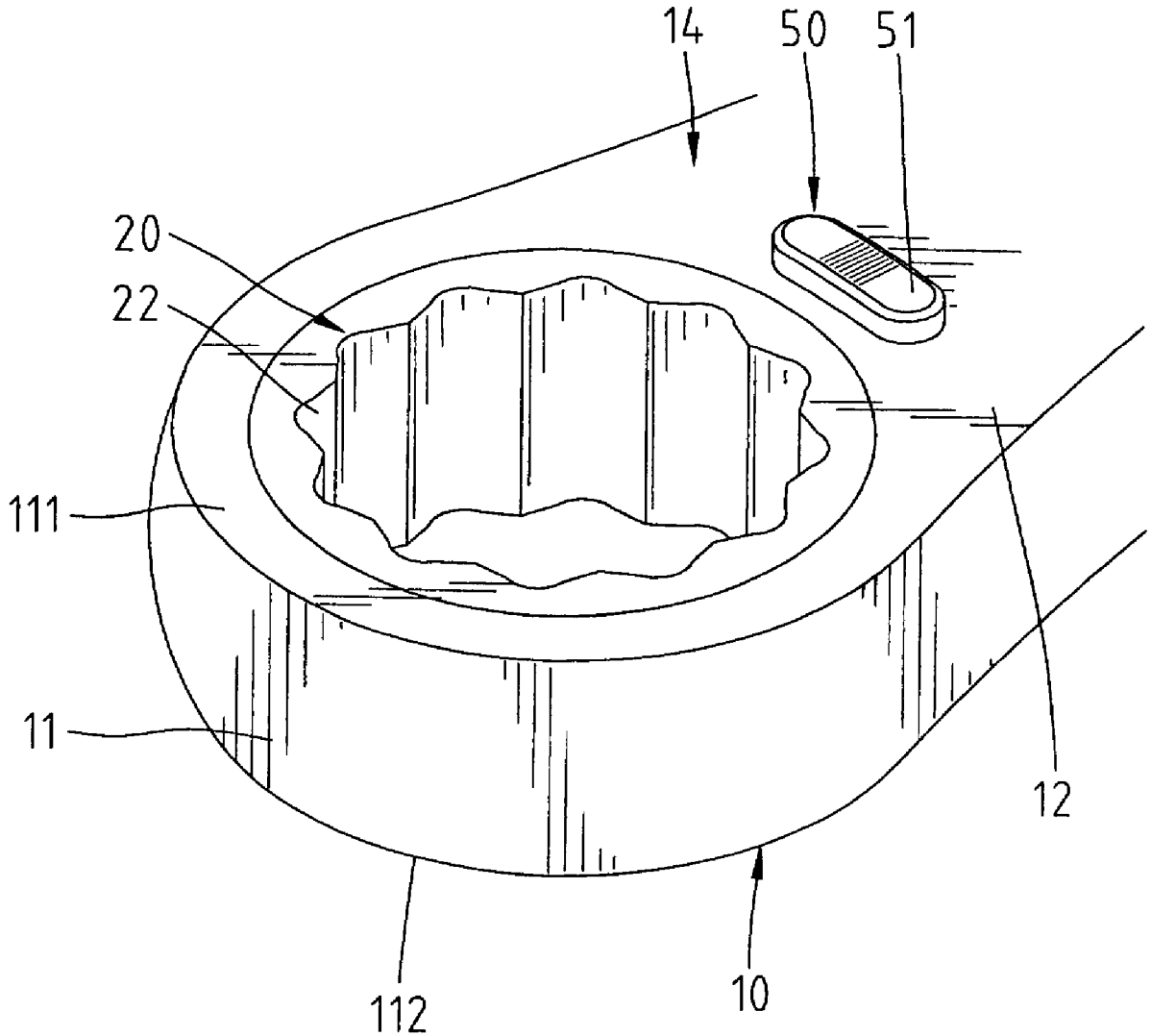
FIG. 11 is a perspective view of a modified embodiment of the ratchet-type reversible wrench in accordance with the present invention.
Figure 12:
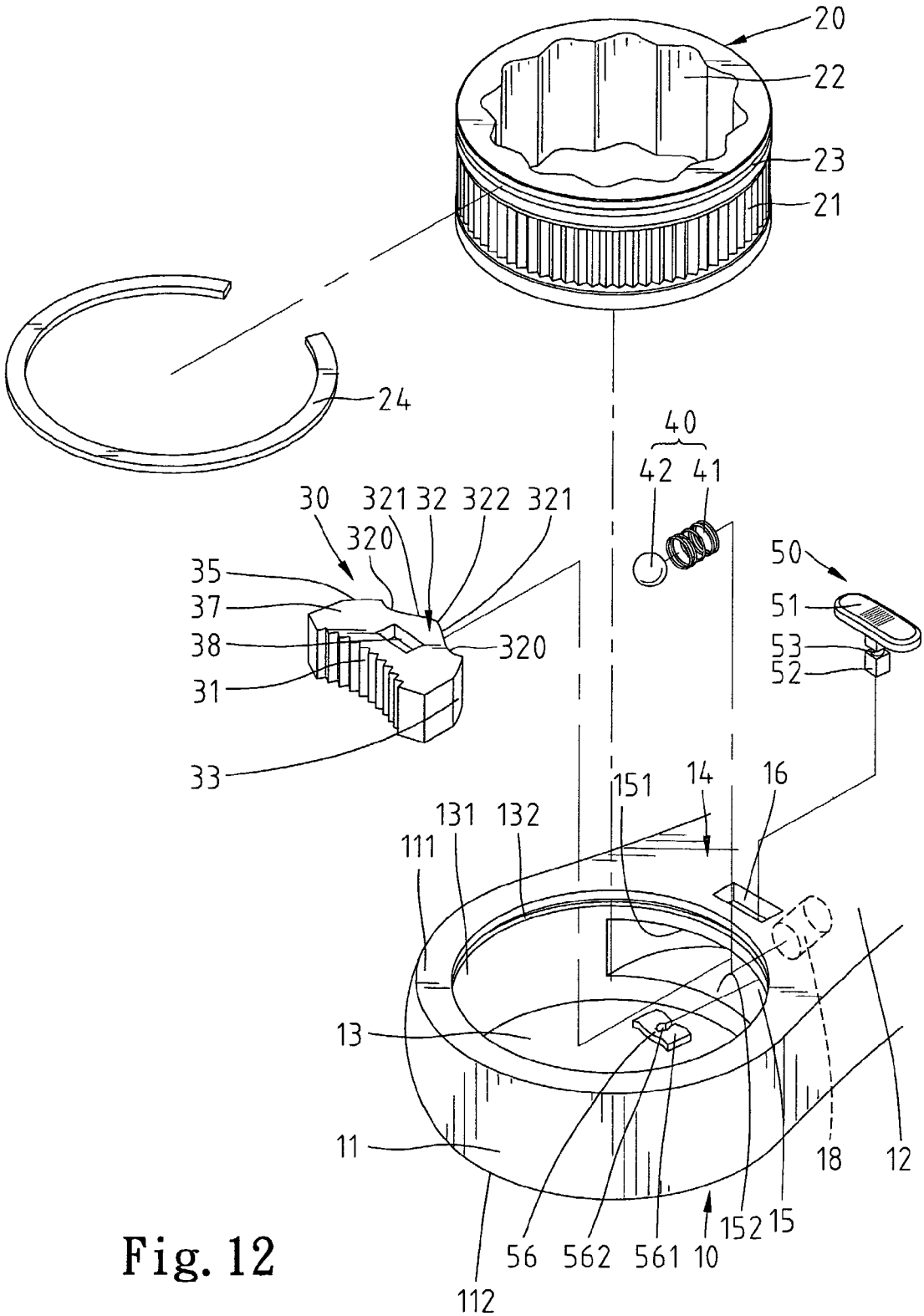
FIG. 12 is an exploded perspective view of the ratchet-type reversible wrench in FIG. 11.

FIGS. 11 and 12 illustrate a modified embodiment of the invention, wherein the only difference between this embodiment and the above embodiment is that the channel 19 in the above embodiment is omitted. It is noted that two lateral sides of the second end 52 of the switching member 50 are respectively guided and limited by two lateral walls defining the opening 16. Thus, undesired rotation of the switching member 50 is prevented.

Figure 13:
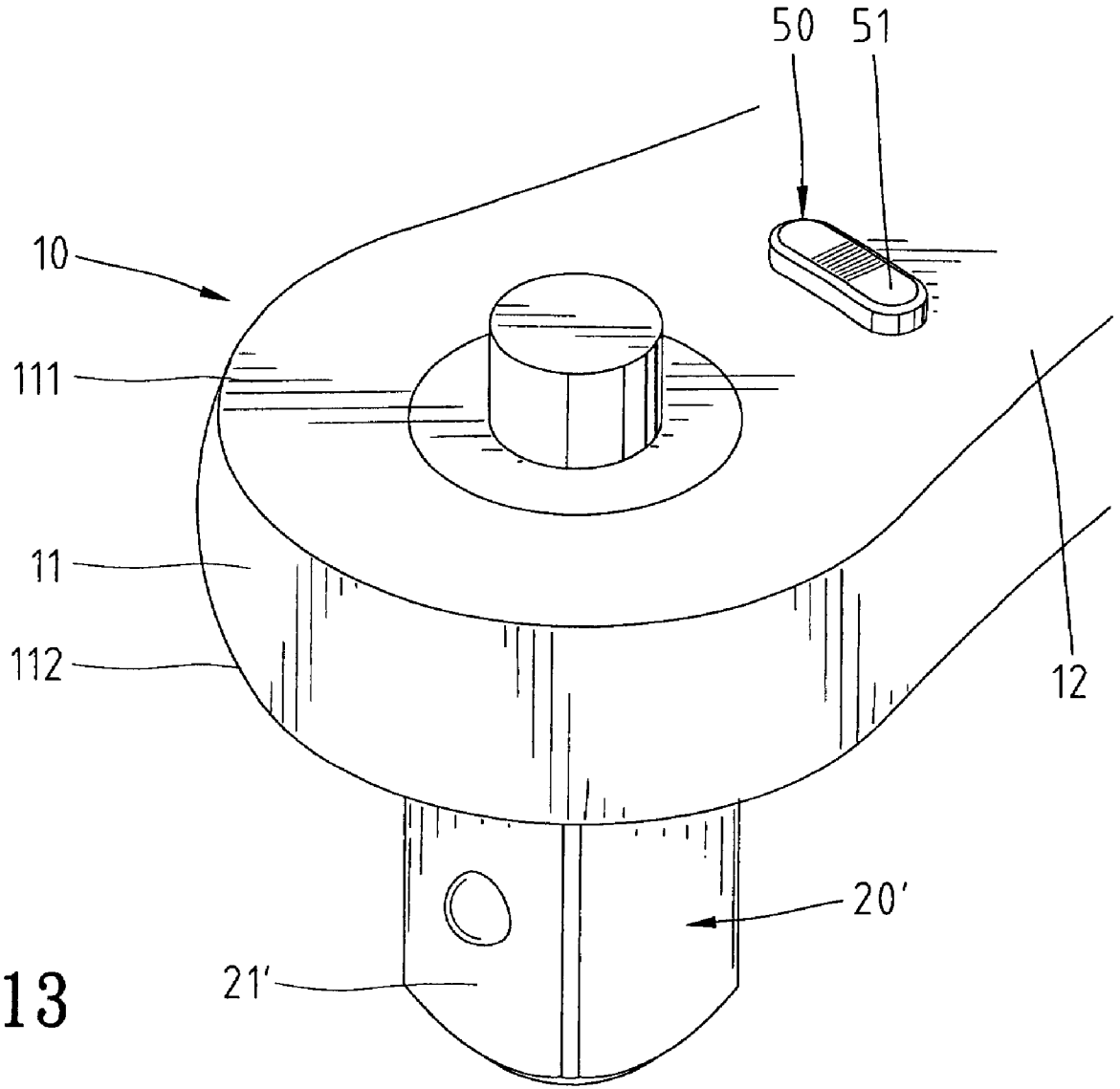
FIG. 13 is a perspective view of another modified embodiment of the ratchet-type reversible wrench in accordance with the present invention.

FIG. 13 illustrates another modified embodiment of the invention, wherein the channel 19 is omitted. In addition, the drive member (now designated by 20') includes a solid gear wheel (not shown) having teeth formed on an outer periphery and a drive column 21' extending downward from a bottom side of the gear wheel for releasably engaging with a socket (not shown). Structure of the head 11 of the wrench 10 is not sacrificed due to provision of the bridge 17.

Figure 14:
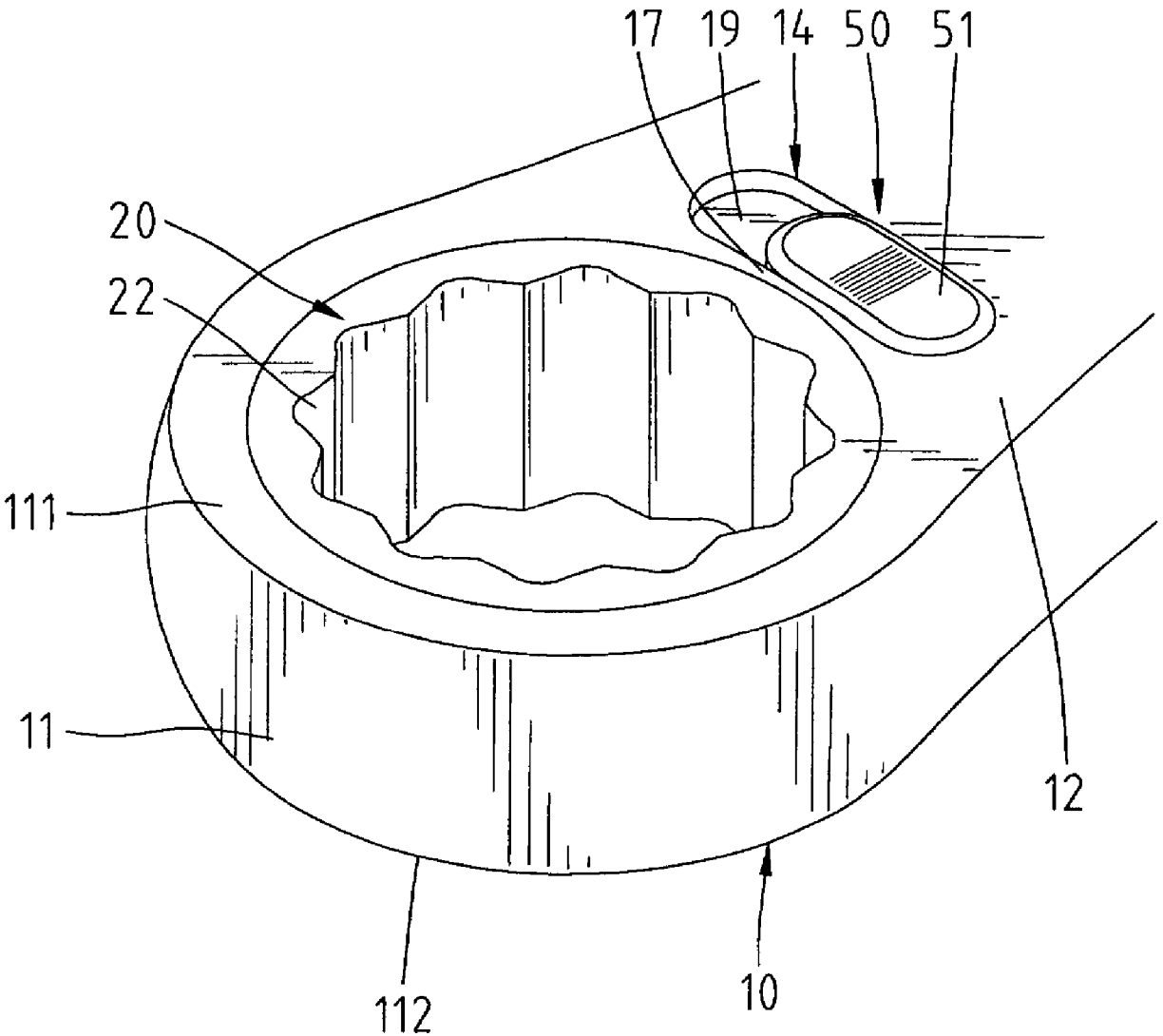
FIG. 14 is a perspective view of a further modified embodiment of the ratchet type reversible wrench in accordance with the present invention.
Figure 15:
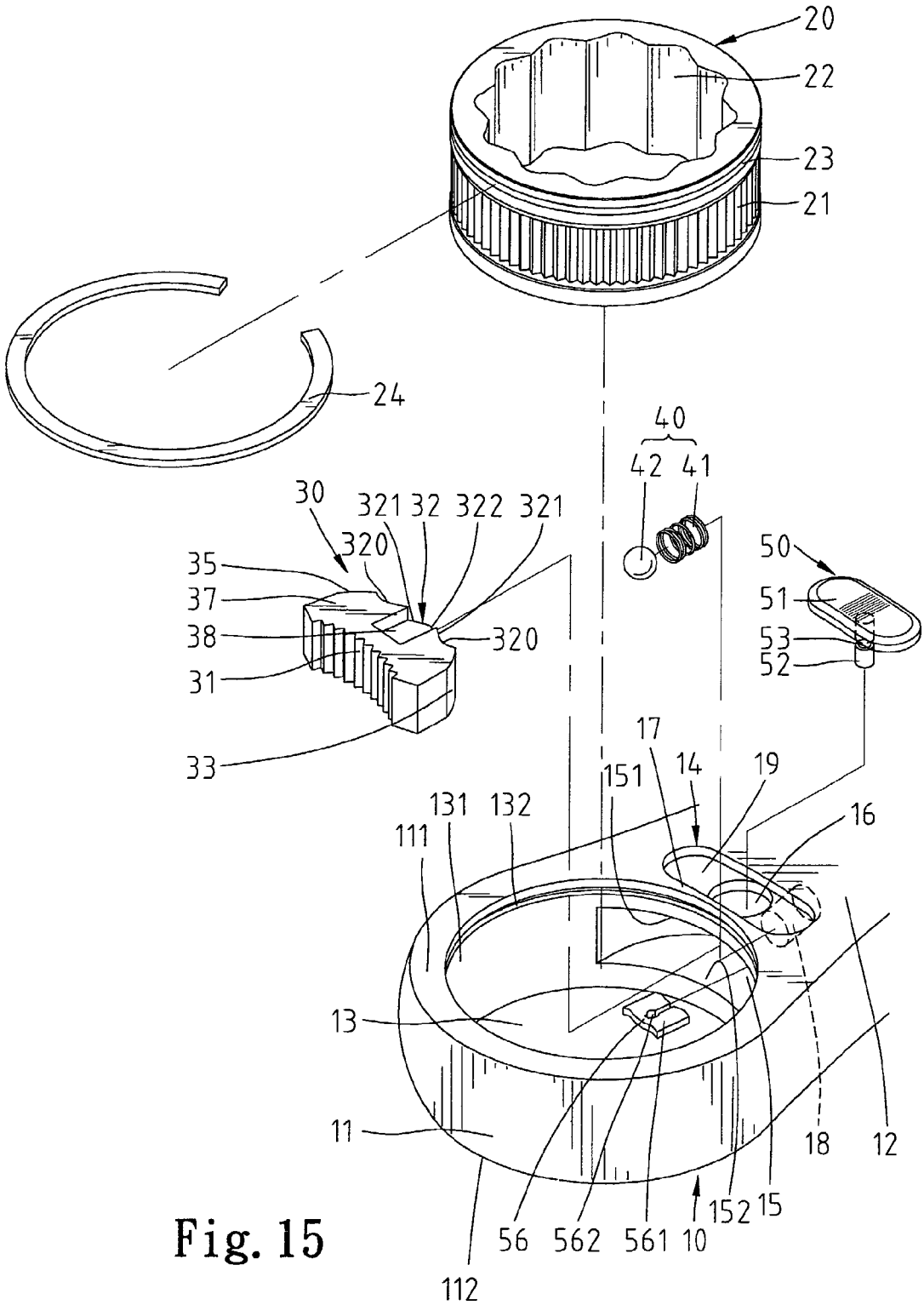
FIG. 15 is an exploded perspective view of the ratchet-type reversible wrench in FIG. 14.
Figure 16:
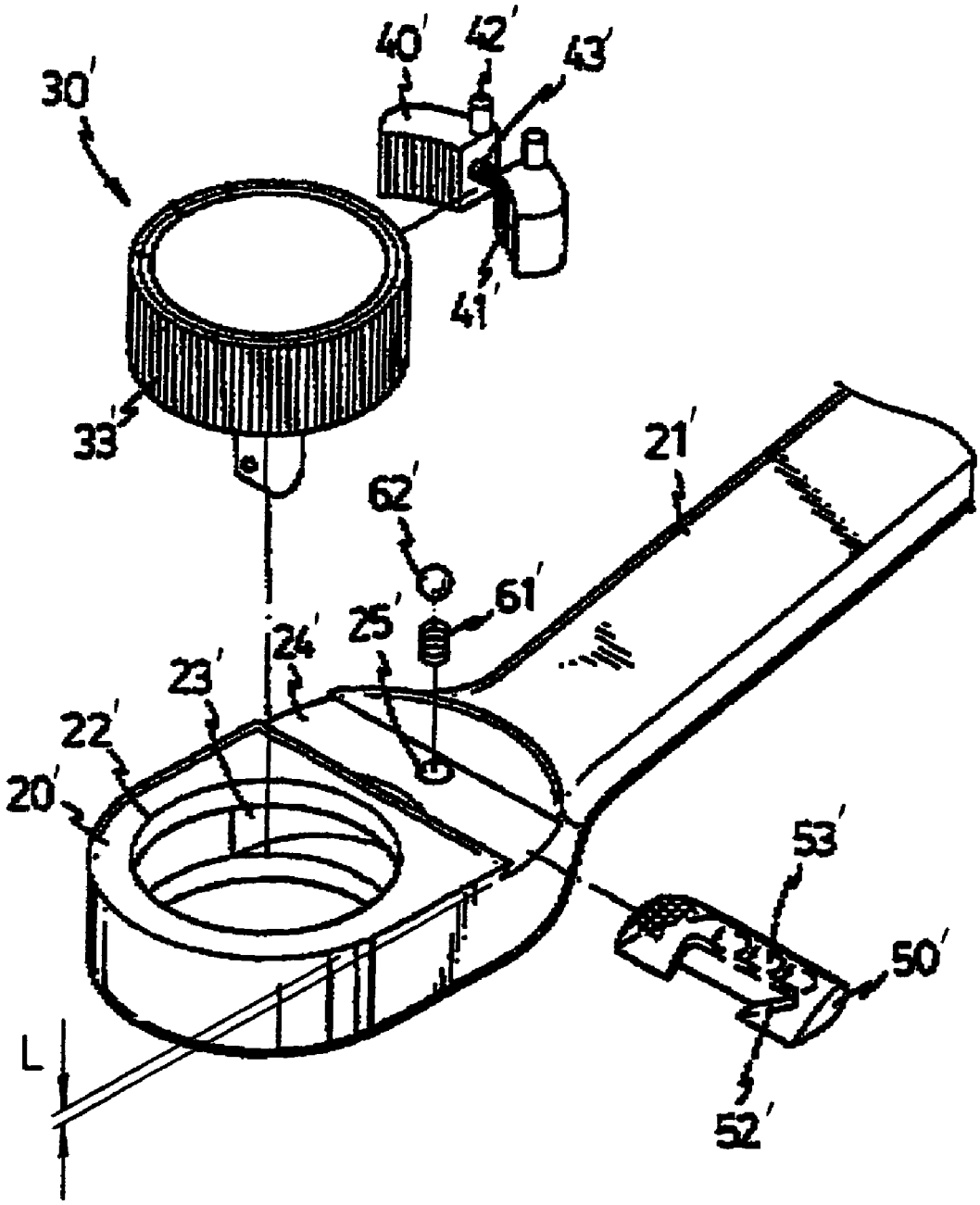
Fig. 16 PRIOR ART
FIG. 16 is an exploded perspective view of a conventional wrench.
Figure 17:
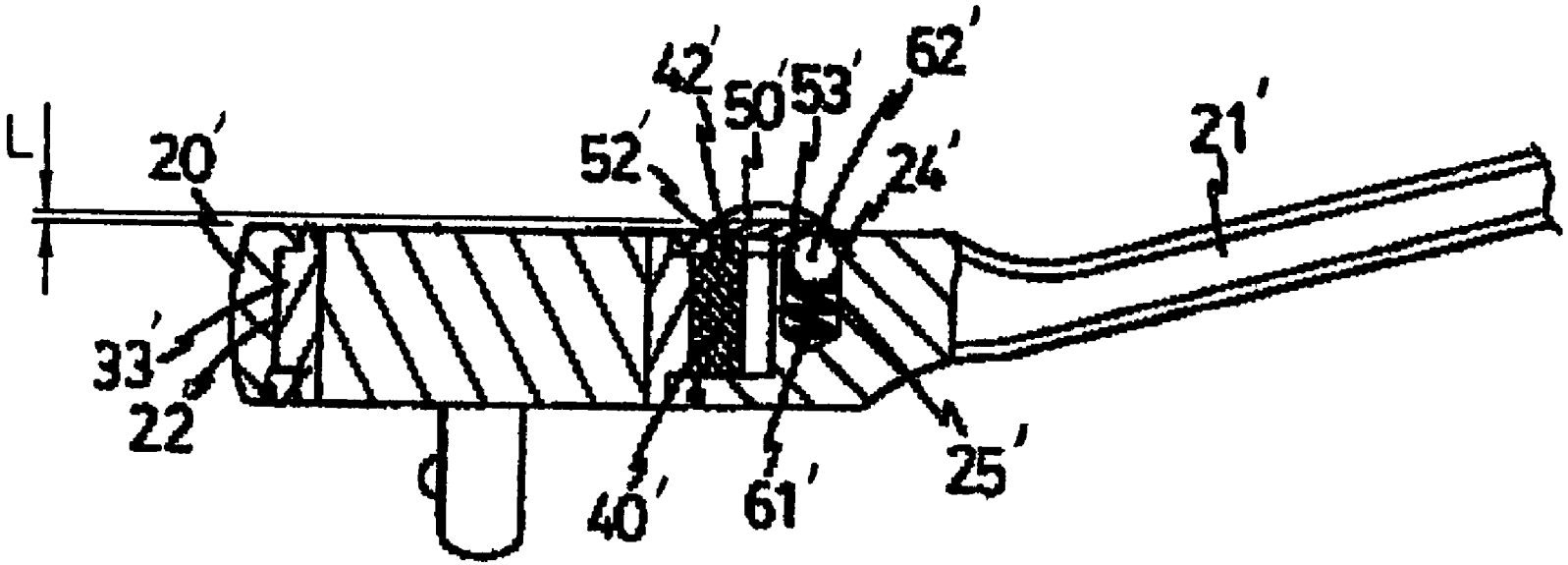
Fig. 17 PRIOR ART
FIG. 17 is a sectional view of the wrench in FIG. 16.
Figure 18:
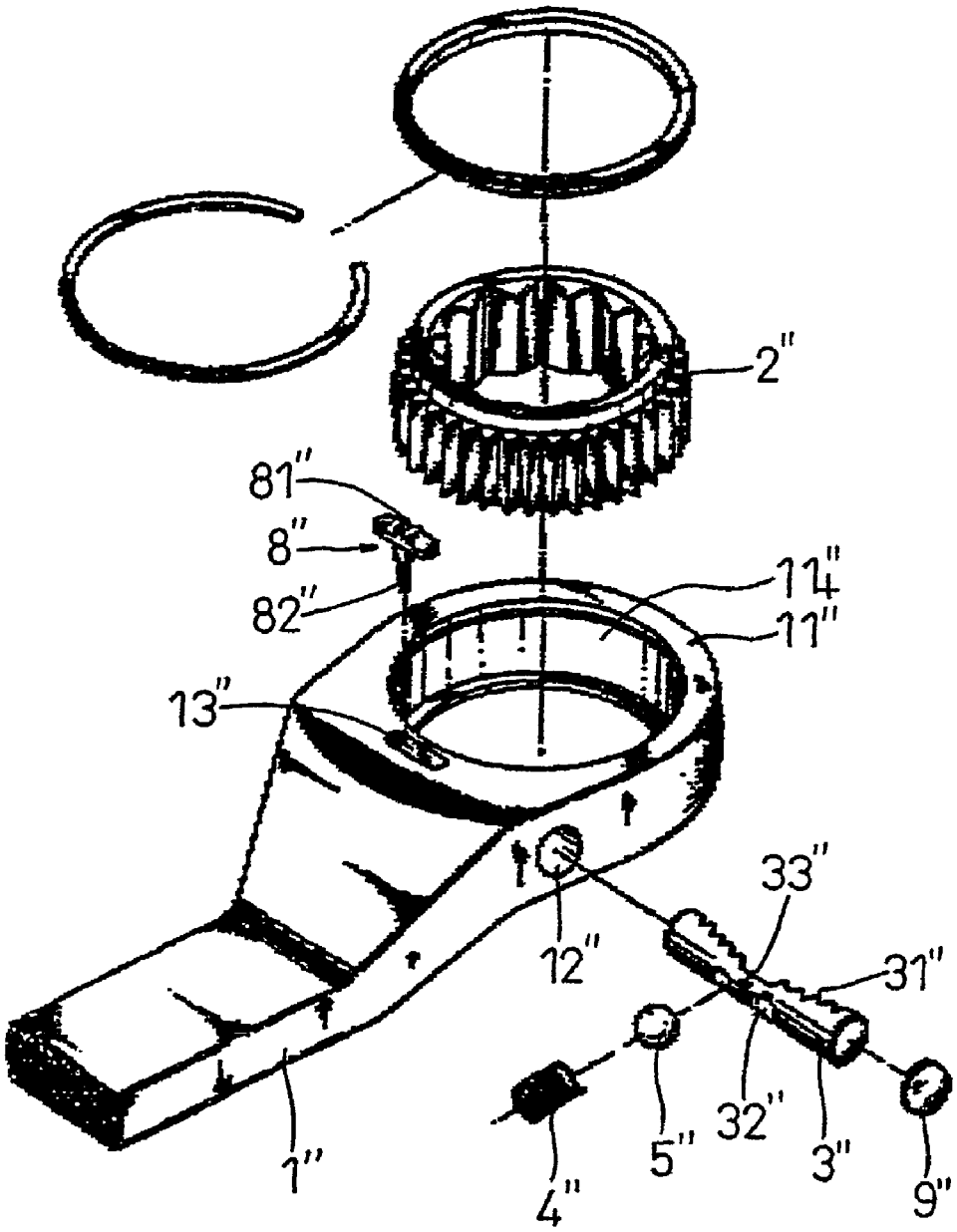
Fig. 18 PRIOR ART
FIG. 18 is an exploded perspective view of another conventional wrench.
Figure 19:
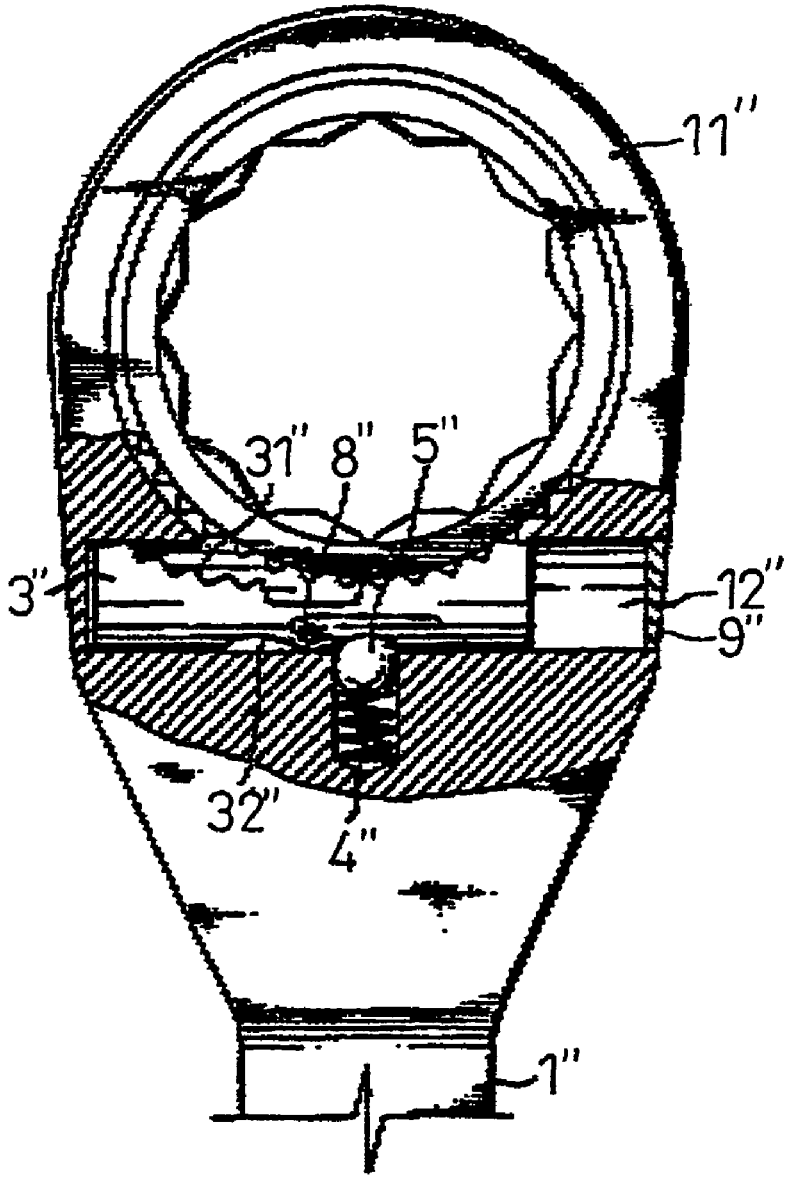
Fig. 19 PRIOR ART
FIG. 19 is a sectional view of the wrench in FIG. 18.

FIGS. 14 and 15 show a further modified embodiment of the invention, wherein the channel 19 is defined in a side of the web 14 and spaced from two lateral sides of the web 14. Further, the opening 16 defined in a bottom wall defining the transverse channel 19 is substantially circular, and the second end 52 of the switching member 50 is cylindrical and extends through the opening 16. The opening 16 allows transverse movement of the switching member 50 relative to the handle 12. It is noted that the second end 52 of the switching member 50 includes two lateral sides that are respectively guided and limited by two lateral walls defining the transverse channel 19. Thus, undesired rotation of the switching member 50 is prevented.

According to the above description, it is appreciated that the switching member 50 is reliably retained in place during ratcheting operation and free rotation of the wrench 10. Structure of the head 11 of the wrench 10 is not sacrificed due to provision of the bridge 17. Further, the pawl 30 is allowed to slide away from the drive member 20 without causing movement of the switching member 50 during free rotation of the wrench 10.

Although the invention has been explained in relation to its preferred embodiments, it is to be understood that many other possible modifications and variations can be made without departing from the scope of the invention as hereinafter claimed.

What is claimed is:

1. A wrench comprising:

a handle;

a head extending from the handle and including a hole;

a web defined between the handle and the head, the web including a side and a compartment communicated with the hole of the head, an opening being defined in the side of the web and communicated with the compartment;

a drive member rotatably mounted in the hole of the head and including a plurality of teeth in an outer periphery thereof;

a pawl slidably received in the compartment and including a first side having a plurality of teeth and a second side opposite to the first side, the pawl further including a recessed portion; and a switching member having a first end for manual operation and a second end extending through the opening of the web into the recessed portion of the pawl, with the first end being of a size larger than the second end and unable to extend through the opening of the web;

wherein the switching member is manually slidable in a sliding direction between a first position and a second position corresponding to two opposite ratcheting directions of the wrench; and wherein the recessed portion of the pawl and the second end of the switching member each has a lateral width parallel to the sliding direction of the switch member between the first and second positions, with the lateral width of the recessed portion being wider than the lateral width of the second end of the switching member, with the second end of the switching member being slideable in the sliding direction relative to the recessed portion, with the pawl slideable in the sliding direction relative to the switch member between an engaged position and a disengaged position, with the pawl in the engaged position being pressed toward the drive member to engage teeth of the plurality of teeth of the pawl with teeth of the plurality of teeth of the drive member for ratcheting operation of the drive member when the drive member is rotated in a corresponding one of the two opposite ratcheting directions, with the pawl in the disengaged position facilitating free rotation operation of the drive member such that the switching member is not moved when the pawl moves as a result of free rotation of the drive member, with the opening being defined by spaced, parallel, lateral walls extending parallel to the sliding direction, with the second end of the switching member including spaced, parallel, lateral sides extending parallel to the sliding direction.

2. The wrench as claimed in claim 1, wherein the web includes a transverse channel defined in the side thereof, the opening of the web being defined in a bottom wall defining the transverse channel.

3. The wrench as claimed in claim 2, wherein the first end of the switching member has a top that is flush with the side of the web.

4. The wrench as claimed in claim 2, wherein the web includes two opposed lateral sides, with the transverse channel extending from one of the two opposed lateral sides through the other of the two opposed lateral sides.

5. The wrench as claimed in claim 1, wherein the switching member is substantially T-shaped.

6. A wrench comprising:

a handle;

a head extending from the handle and including a hole;

a web defined between the handle and the head, with the web including a side and a compartment communicated with the hole of the head, with an opening being defined in the side of the web and communicated with the compartment;

a drive member rotatably mounted in the hole of the head and including a plurality of teeth in an outer periphery thereof;

a pawl slidably received in the compartment and including a first side having a plurality of teeth and a second side opposite to the first side, with the pawl further including a recessed portion;

a switching member having a first end for manual operation and a second end extending through the opening of the web into the recessed portion of the pawl, wherein the second end of the switching member includes an engaging groove; and a resilient retaining plate engaged with the engaging groove, with the resilient retaining plate including at least one curved portion pressing against a wall portion defining the compartment of the web, thereby retaining the switching member in place;

wherein the first end of the switching member is manually slidable to move the pawl between a first position and a second position corresponding to two opposite ratcheting directions of the wrench; and wherein the recessed portion of the pawl and the second end of the switching member are so configured that the switching member is not moved when the pawl moves as a result of free rotation of the wrench.

7. The wrench as claimed in claim 6 wherein the second end of the switching member is a rod having the engaging groove, with the engaging groove being annular, with the recessed portion of the pawl being wider than the rod, with the at least one curved portion including two curved sides pressing against the wall portion defining the compartment of the web, thereby retaining the switching member in place, with the resilient retaining plate further including an intermediate notched portion formed between the curved sides and engaged with the annular engaging groove.

8. The wrench as claimed in claim 1, wherein a cavity is defined in a wall defining the compartment, with the second side of the pawl being pressed toward the drive member for engaging the pawl with the drive member by a pressing member biased by an elastic element, with the elastic element and the pressing member being mounted in the cavity in the compartment.

9. The wrench as claimed in claim 8, wherein the second side of the pawl includes two retaining grooves spaced by a ridge.

10. The wrench as claimed in claim 1, wherein the pawl includes two pressing ends for selectively pressing a peripheral wall defining the compartment.

11. The wrench as claimed in claim 1, wherein the drive member is a gear wheel having an inner periphery.

12. The wrench as claimed in claim 1, wherein the drive member includes a gear wheel and a drive column for engaging with a socket.

13. The wrench as claimed in claim 1, wherein a bridge is delimited between the opening of the web and the hole of the head.

14. The wrench as claimed in claim 2, wherein the first end of the switching member includes two lateral sides that are respectively guided and limited by two lateral walls defining the transverse channel, thereby preventing rotation of the switching member.

15. A wrench comprising:

a handle;

a head extending from the handle and including a hole;

a web defined between the handle and the head, with the web including a side and a compartment communicated with the hole of the head, with an opening being defined in the side of the web and communicated with the compartment;

a drive member rotatably mounted in the hole of the head and including a plurality of teeth in an outer periphery thereof;

a pawl slidably received in the compartment and including a first side having a plurality of teeth and a second side opposite to the first side, with the pawl further including a recessed portion; and a switching member having a first end for manual operation and a second end extending through the opening of the web into the recessed portion of the pawl, with the first end being of a size larger than the second end and unable to extend through the opening of the web, wherein the second end of the switching member includes two, spaced, parallel lateral sides that are respectively guided and limited by two, spaced, parallel lateral walls defining the opening, thereby preventing rotation of the switching member and the first end of the switching member;

wherein the first end of the switching member is manually slidable to move the pawl between a first position and a second position corresponding to two opposite ratcheting directions of the wrench; and wherein the recessed portion of the pawl and the second end of the switching member are so configured that the switching member is not moved when the pawl moves as a result of free rotation of the wrench.

16. The wrench as claimed in claim 1, with the recessed portion of the pawl, the second end of the switching member, and the opening in the web each being rectangular.

17. The wrench as claimed in claim 6 with the pawl being pressed toward the drive member by a pressing member biased by an elastic element, with the pressing member mounted in the compartment, with the elastic element mounted in the compartment for urging the pressing member to press against the second side of the pawl for engaging the teeth of the pawl with the teeth of the drive member.

18. The wrench as claimed in claim 1 with the pawl being pressed toward the drive member by a pressing member biased by an elastic element, with the pressing member mounted in the compartment, with the elastic element mounted in the compartment for urging the pressing member to press against the second side of the pawl for engaging the teeth of the pawl with the teeth of the drive member.

19. The wrench as claimed in claim 15 with the pawl being pressed toward the drive member by a pressing member biased by an elastic element, with the pressing member mounted in the compartment, with the elastic element mounted in the compartment for urging the pressing member to press against the second side of the pawl for engaging the teeth of the pawl with the teeth of the drive member.

20. The wrench as claimed in claim 15 with the pawl further comprising two pressing ends for selectively pressing a peripheral wall defining the compartment, with the second side of the pawl including two retaining grooves spaced by a ridge, with the pawl being pressed toward the drive member by a pressing member biased by an elastic element, with one of the two retaining grooves on the second side of the pawl guiding the pressing member to press a corresponding one of the two pressing ends against the peripheral wall defining the compartment to enhance engagement of the teeth of the pawl and the teeth of the drive member when the drive member is rotated in the corresponding one of the two opposite ratcheting directions.

* * * * *